US008938085B2

(12) United States Patent
Matsui et al.

(10) Patent No.: US 8,938,085 B2
(45) Date of Patent: Jan. 20, 2015

(54) MICROPHONE ADAPTER AND MICROPHONE

(75) Inventors: Noriko Matsui, Tokyo (JP); Hiroshi Akino, Kanagawa (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 337 days.

(21) Appl. No.: 13/480,564

(22) Filed: May 25, 2012

(65) Prior Publication Data

US 2013/0004009 A1 Jan. 3, 2013

(30) Foreign Application Priority Data

Jun. 30, 2011 (JP) ..... 2011-145256

(51) Int. Cl.
*H04R 9/08* (2006.01)
*H04R 1/34* (2006.01)
*H04R 11/04* (2006.01)

(52) U.S. Cl.
CPC ..... *H04R 1/342* (2013.01)
USPC ..... 381/356; 381/355

(58) Field of Classification Search
CPC ..... H04R 1/08; H04R 1/26; H04R 1/138; H04R 1/345; H04R 1/342; H04R 1/403; H04R 1/406; H04R 5/02; H04M 1/03
USPC ..... 381/87, 91, 160, 355–358
See application file for complete search history.

(56) References Cited

U.S. PATENT DOCUMENTS 3,895,188 A * 7/1975 Ingraham ..... 381/160
8,194,895 B2 * 6/2012 Akino ..... 381/355

FOREIGN PATENT DOCUMENTS

JP 2007-028027 2/2007

* cited by examiner

*Primary Examiner* — Brian Ensey
(74) *Attorney, Agent, or Firm* — Whitham Curtis Christofferson & Cook, PC

(57) ABSTRACT

A microphone adapter is attachable to a microphone including a microphone unit and a casing having a front sound terminal and a back sound terminal. The microphone adapter has a bottom having a hole through which the casing of the microphone extends and a cylindrical peripheral wall integrated with the bottom, having an open end opposite to the bottom, and covering the periphery of the back sound terminal. The cylindrical peripheral wall has an internal diameter larger than the external diameter of the casing of the microphone so as to define a space between the cylindrical peripheral wall and the external peripheral surface of the casing of the microphone extending through the hole, and extends from the bottom at least to a position of the front sound terminal in a sound collection axis direction.

11 Claims, 6 Drawing Sheets

OMNIDIRECTIONAL

MICROPHONE ADAPTER AND MICROPHONE

BACKGROUND OF THE INVENTION

1. Field of the Invention

The present invention relates to a microphone adapter and a microphone, the microphone adapter switching a unidirectional microphone to an omnidirectional microphone, for example.

2. Related Background Art

Microphones have unique directivities depending on their structures. For instance, a microphone attached over the chest of a speaker is a lavalier microphone, which is unidirectional or omnidirectional. To use different directivities depending on purposes of use, a user should prepare a plurality of lavalier microphones having different directivities, which is economically disadvantageous. Thus, a microphone that can switch directivity is strongly demanded.

Example methods of switching the directivity of a microphone include replacing a microphone unit with another microphone unit having a different directivity (Japanese Unexamined Patent Application Publication No. 2007-028027) and changing the mixing ratio of outputs from two diaphragms provided on two surfaces of a rear electrode of a condenser microphone unit to change directivity.

It is cumbersome, however, to replace a microphone unit with another one since the microphone should be disassembled for replacement. In addition, a microphone unit may be damaged as a user touches it with the user's bare hands. It is also uneconomical to purchase a plurality of expensive microphone units having different directivities.

It is easy in terms of handling to change the mixing ratio of the outputs from the two diaphragms to change the directivity since the directivity can be changed by switching a switch on a microphone main body. This method requiring two microphone units is also uneconomical.

An inexpensive and easy method of changing the directivity of a microphone is to provide a component that changes the distance between sound terminals. For instance, an accessory PPC1000 is prepared for an AKG's microphone C1000S. The C1000S, which is originally a unidirectional microphone, can have sharper directivity with the PPC1000 attached.

Although the microphone accessory allows the microphone to have sharper directivity, the microphone accessory cannot change the directivity itself. Thus, an easily attached and inexpensive accessory is desired for a microphone to change the directivity itself.

SUMMARY OF THE INVENTION

In view of the circumstances above, an object of the present invention is to provide an inexpensive easy-to-use microphone adapter that switches the directivity of a microphone from unidirectional to omnidirectional.

The present invention provides a microphone adapter attachable to a microphone including a microphone unit and a casing, the microphone unit including a diaphragm, the casing including the microphone unit and having a front sound terminal that directs sound waves to a first surface of the diaphragm and a back sound terminal that directs sound waves to a second surface of the diaphragm, the microphone adapter including a bottom having a hole through which the casing of the microphone extends; and a cylindrical peripheral wall integrated with the bottom, having an open end opposite to the bottom, and covering a periphery of the back sound terminal. The cylindrical peripheral wall has an internal diameter larger than an external diameter of the casing of the microphone so as to define a space between the cylindrical peripheral wall and an external peripheral surface of the casing of the microphone extending through the hole, and extends from the bottom at least to a position of the front sound terminal in a sound collection axis direction.

DESCRIPTION OF THE PREFERRED EMBODIMENTS

A microphone adapter and a microphone according to an embodiment of the present invention are described below with reference to the attached drawings.

Figure 1A:
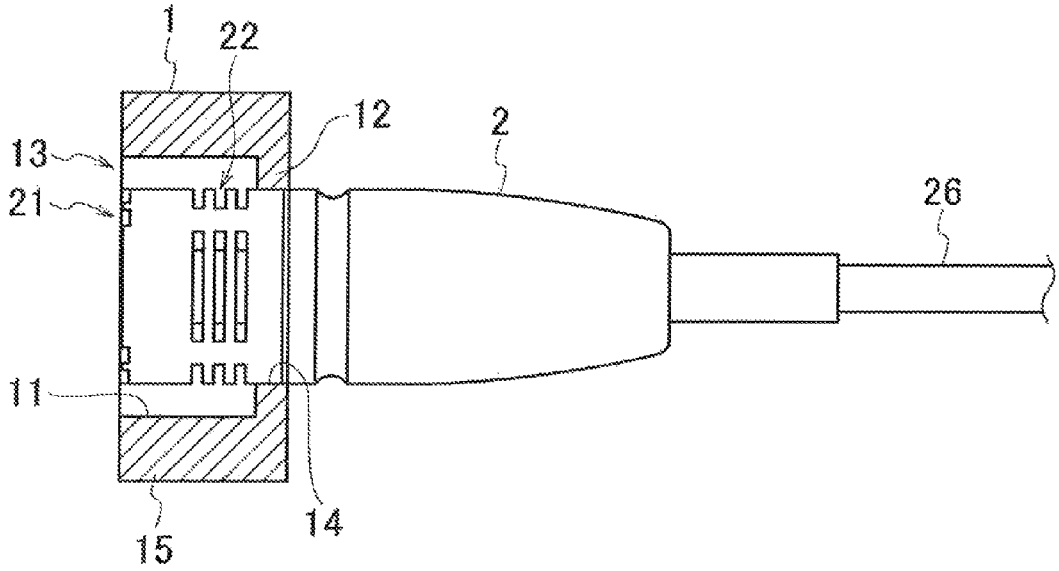
FIG. 1A is a partial cross-sectional front view illustrating a microphone adapter and a microphone according to an embodiment of the present invention.
Figure 1B:
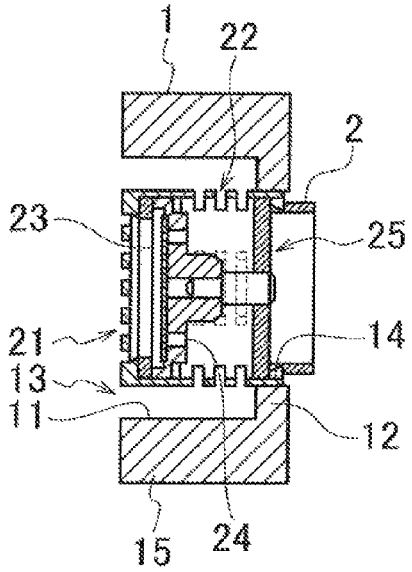
FIG. 1B is a cross-sectional front view illustrating the main portion of the microphone adapter and the microphone according to the embodiment.

With reference to FIGS. 1A and 1B, a microphone adapter 1 is mounted on a front end portion of a microphone 2.

Figure 2A:
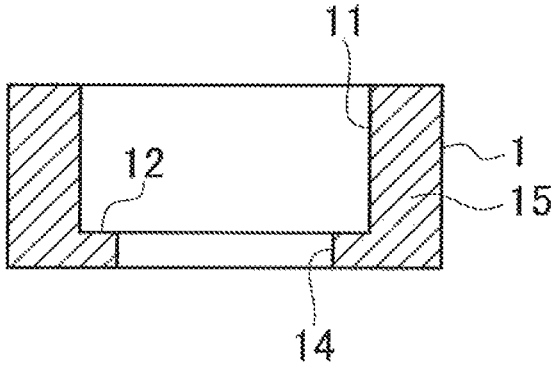
FIG. 2A is a vertical cross-sectional view of the microphone adapter.
Figure 2B:
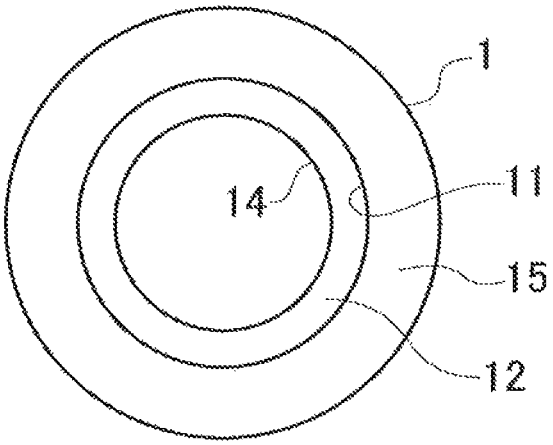
FIG. 2B is a plan view of the microphone adapter.

With reference to FIGS. 2A and 2B, the microphone adapter 1 is a plastic member having a cylindrical peripheral wall 15 with a first open end. A bottom 12 is provided in a second end of the peripheral wall 15 of the microphone adapter 1. The bottom 12 has a hole 14 having a diameter through which a casing of the microphone 2 described below can be inserted. The diameter of the internal surface 11 of the peripheral wall 15 is larger than the diameter of the hole 14, specifically, the external diameter of the casing of the microphone 2 that passes through the hole 14. Thus, as shown in FIGS. 1A and 1B, a cylindrical space having a predetermined width is defined between the internal surface 11 of the peripheral wall 15 of the microphone adapter 1 and the external surface of the casing of the microphone 2 after the microphone adapter 1 is attached to the microphone 2.

The cylindrical peripheral wall 15 of the microphone adapter 1 is integrated with the bottom 12 and has the open end opposite to the bottom 12. The peripheral wall 15 has an internal diameter larger than the external diameter of the casing of the microphone 2 to define a space between the peripheral wall 15 and the external surface of the casing of the microphone 2 that passes through the hole 14. The peripheral wall 15 extends from the bottom 12 at least to a front sound terminal of the microphone 2 in a sound collection axis.

The microphone 2 has a microphone unit 25 in the substantially cylindrical casing. The front sound terminal 21 is provided in a front end portion of the casing of the microphone 2, the front sound terminal 21 directing external sound to the front surface of a diaphragm 23 of the microphone unit 25 in the casing. A back sound terminal 22 is provided on the back of the front sound terminal 21, the back sound terminal 22 directing external sound to the rear surface of the diaphragm 23 through a guide hole 24. A cord 26 extends from the rear end of the microphone 2. The microphone unit 25 in the embodiment is a condenser microphone unit having unidirectivity.

Figure 3A:
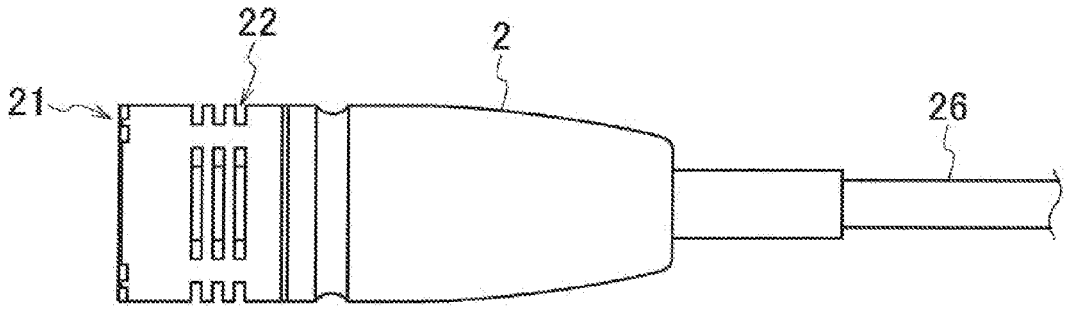
FIG. 3A is a front view of the microphone.
Figure 3B:
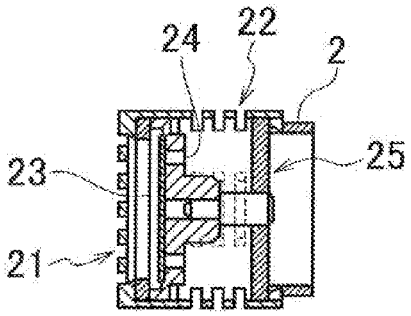
FIG. 3B is a vertical cross-sectional view of the main portion of the microphone.
Figure 4:
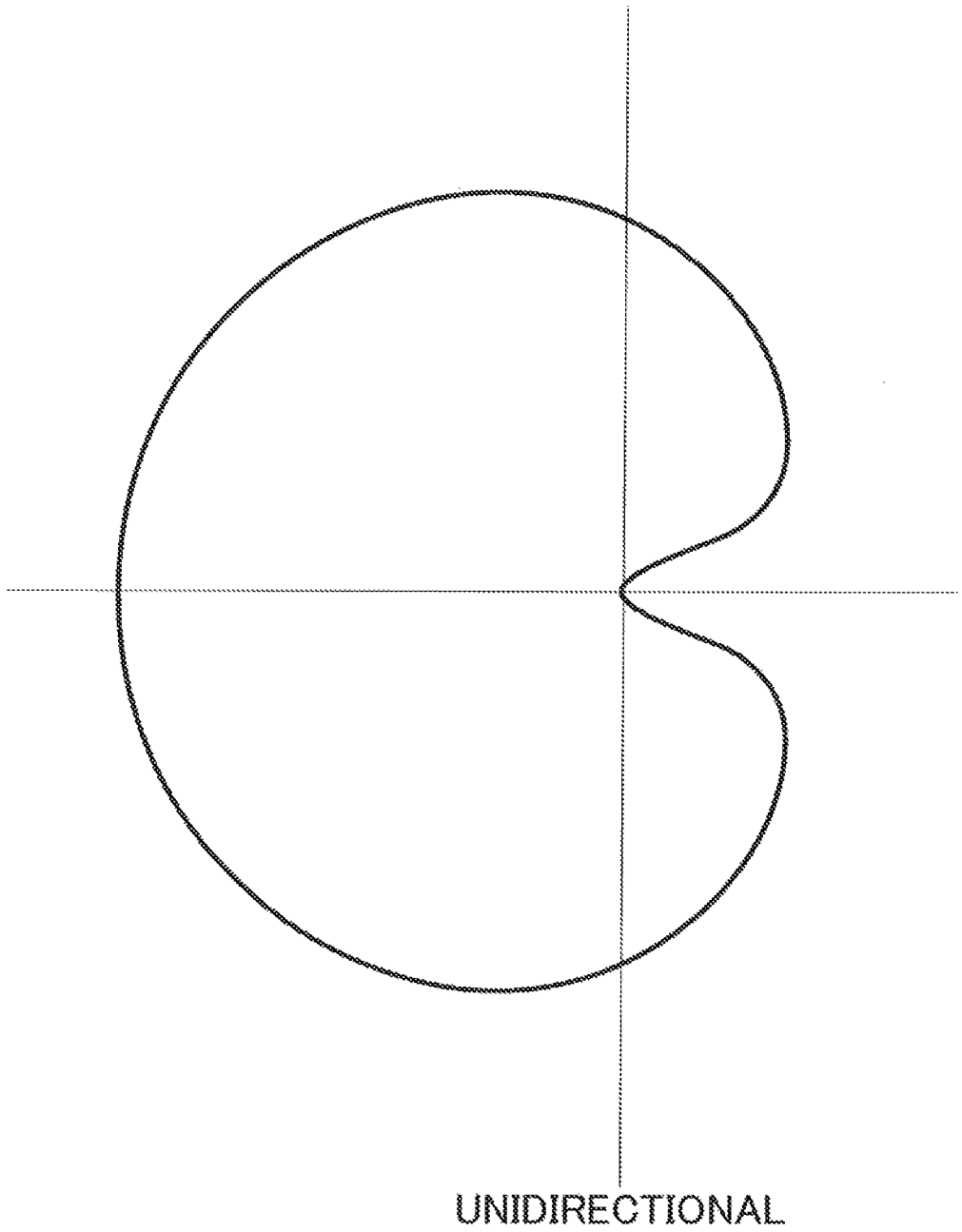
FIG. 4 is a graph illustrating the directivity of the microphone.

With reference to FIGS. 3A and 3B, the microphone 2 is unidirectional without the microphone adapter 1 mounted thereon as shown in FIG. 4. The principal thereof is described below.

Sound from the front enters the microphone unit 25 through the front sound terminal 21 and reaches the front surface of the diaphragm 23. The sound from the front vibrates the diaphragm 23 and is then transduced into electrical signals. The same sound also travels to the back sound terminal 22, enters the microphone unit 25 therethrough, and reaches the rear surface of the diaphragm 23 through the guide hole 24. The arrival of the same sound to the rear surface is later than that to the front surface due to an obstacle, such as an acoustic resistant material (not shown in the drawing). Thus, the sound from the front through the front sound terminal 21, which is not affected by the sound from the front through the back sound terminal 22, vibrates the diaphragm 23 and the vibration is transduced into electrical signals.

Sound from the back enters the microphone unit 25 through the back sound terminal 22 and reaches the rear surface of the diaphragm 23 through the guide hole 24. The sound from the back travels around the microphone 2, enters the microphone unit 25 slightly late through the front sound terminal 21, and reaches the front surface of the diaphragm 23. At this time, the arrival timing of the sound through the back sound terminal 22 to the diaphragm 23 is controlled to be the same as the arrival of the sound to the front surface of the diaphragm 23 through the front sound terminal 21 by the acoustic resistant material. Thus, the sound from the back, which includes the sound through the front sound terminal 21 and the sound through the back sound terminal 22, is concurrently generated in the front and rear of the diaphragm 23 and is offset as being energy of the same amount. Accordingly, the diaphragm 23 does not vibrate and the sound is by no means transduced into electrical signals. Thereby, the microphone 2 is unidirectional.

Figure 5:
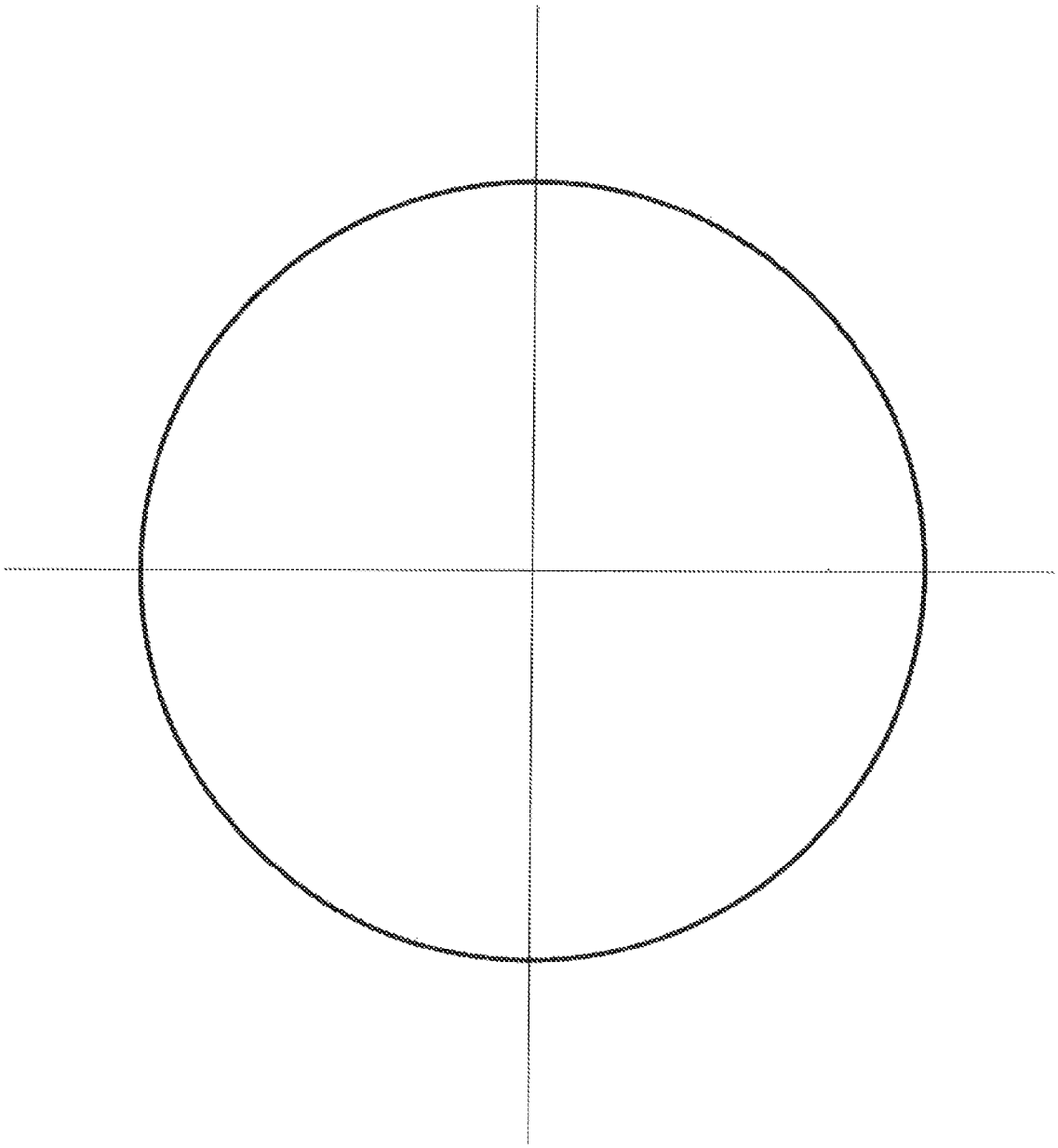
FIG. 5 is a graph illustrating the directivity of the microphone on which the microphone adapter is mounted.

With reference to FIGS. 1A and 1B, meanwhile, the microphone 2 is omnidirectional with the microphone adapter 1 mounted thereon as shown in FIG. 5. The principal thereof is described below.

With the microphone adapter 1 mounted on the casing of the microphone 2, a cylindrical space 13 having a predetermined width is defined between the internal surface 11 of the peripheral wall 15 of the microphone adapter 1 and the external surface of the casing of the microphone 2. The space 13 extends from the back of the back sound terminal 22 along the sound collection axis to the position of the open end of the peripheral wall 15, specifically, to the position of the front sound terminal 21 along the sound collection axis. Thus, the front sound terminal 21 and the back sound terminal 22 of the microphone 2 have the same sound wave introduction position along the sound collection axis. Accordingly, sound from any direction to the microphone 2 is directed to the front sound terminal 21 and the back sound terminal 22 through the same sound wave introduction position.

If the sound wave introduction position is the same for the front sound terminal 21 and the back sound terminal 22, the sound reaches the rear surface of the diaphragm 23 through the back sound terminal 22 later than the sound reaching the front surface of the diaphragm 23 through the front sound terminal 21 due to the length of a path to the rear surface of the diaphragm 23 and the acoustic resistant material. Thus, the sound from the front sound terminal 21 vibrates the diaphragm 23 without being affected by the sound from the back sound terminal 22 and the vibration is transduced into electrical signals. Specifically, the diaphragm 23 vibrates in response to sound from any direction and the vibration is transduced into electrical signals, and thus the directivity of the microphone 2 is changed from unidirectional to omnidirectional.

As described above, the microphone adapter for changing the directivity according to the present invention has a simple structure and is an integrated plastic molding product, thus reducing the production cost. Accordingly, it is unnecessary to prepare a plurality of expensive microphone units for switching directivity in a conventional technique, and thus it is economical. In addition, the directivity can be switched by simply mounting the microphone adapter on the exterior of the casing of the microphone without disassembly thereof, thus allowing easy switching of the directivity. Furthermore, the directivity of a unidirectional microphone can be changed to omnidirectional, which cannot be achieved with a conventional microphone adapter.

Figure 6:
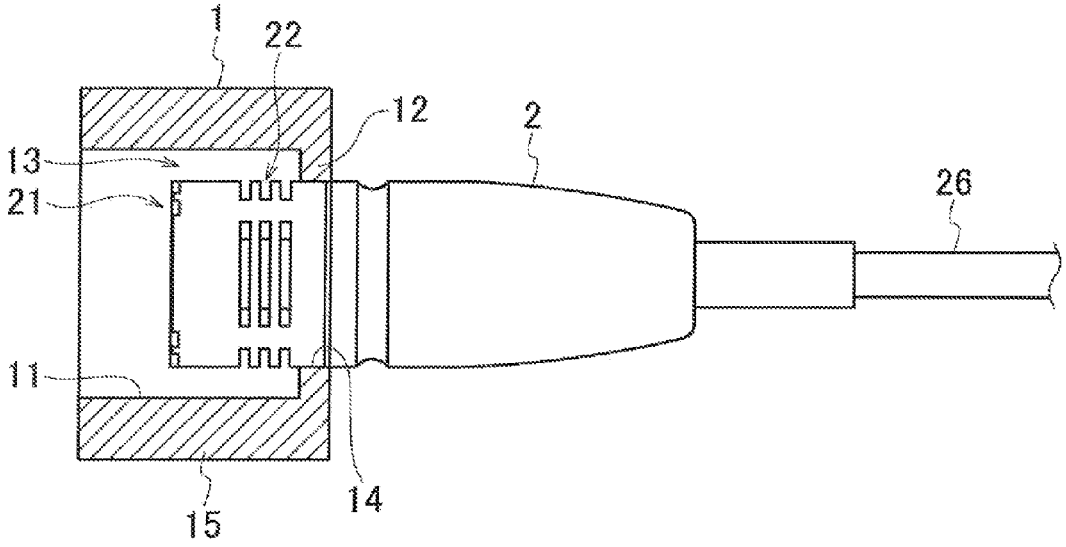
FIG. 6 is a partial cross-sectional front view illustrating a microphone adapter and a microphone according to another embodiment of the present invention.

The peripheral wall 15 of the microphone adapter 1 should extend in the sound collection axis direction at least to the position of the front sound terminal of the microphone 2 in a state where the casing of the microphone 2 is inserted through the hole 14. The peripheral wall 15 may extend to the front of the front sound terminal as shown in the embodiment of FIG. 6. In the embodiment of FIG. 6, the sound wave introduction position is also the same for the front sound terminal 21 and the back sound terminal 22 of the microphone 2 in the sound collection axis direction, thus achieving the same effect as that in the embodiment.

The present invention is not limited to the embodiment above, and may be embodied in a variety of modes. For example, the material of the microphone adapter is not limited to plastic, but may be wood. Any method of electroacoustic transduction may be employed for the microphone unit.

What is claimed is:

1. A microphone adapter attachable to a microphone comprising a microphone unit and a casing, the microphone unit including a diaphragm, the casing including the microphone unit and having a front sound terminal that directs sound waves to a first surface of the diaphragm and a back sound terminal that directs sound waves to a second surface of the diaphragm, the microphone adapter comprising:

a bottom having a hole through which the casing of the microphone extends; and a cylindrical peripheral wall integrated with the bottom, having an open end opposite to the bottom, and covering a periphery of the back sound terminal, wherein the cylindrical peripheral wall has an internal diameter larger than an external diameter of the casing of the microphone so as to define a space between the cylindrical peripheral wall and an external peripheral surface of the casing of the microphone extending through the hole, and extends from the bottom at least to a position of the front sound terminal in a sound collection axis direction, and wherein the space between the cylindrical peripheral wall and an external peripheral surface of the casing is cylindrical.

2. The microphone adapter according to claim 1, wherein the cylindrical peripheral wall extends to the position of the front sound terminal of the microphone in the sound collection axis direction.

3. The microphone adapter according to claim 1, wherein the cylindrical peripheral wall extends to a front of the position of the front sound terminal of the microphone in the sound collection axis direction.

4. The microphone adapter according to claim 1, wherein the microphone adapter comprises a plastic material.

5. The microphone adapter according to claim 1, wherein a diameter of an internal peripheral surface of the microphone adapter is larger than a diameter of the hole in the bottom, and the space is defined between the internal peripheral surface of the microphone adapter and the external peripheral surface of the casing of the microphone after the microphone adapter is attached to the microphone.

6. The microphone adapter according to claim 1, wherein the microphone is unidirectional whereas the microphone with the microphone adaptor mounted thereon is omnidirectional.

7. The microphone adapter according to claim 5, wherein the microphone is unidirectional whereas the microphone with the microphone adaptor mounted thereon is omnidirectional.

8. A microphone comprising:

a microphone unit including a diaphragm;

a casing including the microphone unit and having a front sound terminal that directs sound waves to a first surface of the diaphragm and a back sound terminal that directs sound waves to a second surface of the diaphragm; and a detachable microphone adapter attached to the casing, the microphone adapter comprising:

a bottom having a hole through which the casing extends; and a cylindrical peripheral wall integrated with the bottom, having an open end opposite to the bottom, and covering a periphery of the back sound terminal, wherein the cylindrical peripheral wall has an internal diameter larger than an external diameter of the casing so as to define a space between the cylindrical peripheral wall and an external peripheral surface of the casing extending through the hole, and extends from the bottom at least to a position of the front sound terminal in a sound collection axis direction, and wherein the space between the cylindrical peripheral wall and an external peripheral surface of the casing is cylindrical.

9. The microphone according to claim 8, wherein a diameter of an internal peripheral surface of the microphone adapter is larger than a diameter of the hole in the bottom, and the space is defined between the internal peripheral surface of the microphone adapter and the external peripheral surface of the casing after the microphone adapter is attached to the microphone.

10. The microphone adapter according to claim 1, wherein the front sound terminal and the back sound terminal have a same sound wave introduction position along the sound collection axis.

11. The microphone according to claim 8, wherein the front sound terminal and the back sound terminal have a same sound wave introduction position along the sound collection axis.

* * * * *